US008494381B2

(12) United States Patent
Deng

(10) Patent No.: US 8,494,381 B2
(45) Date of Patent: Jul. 23, 2013

(54) HEATING UNIT AND ITS MALFUNCTION DETERMINING METHOD, IMAGE FIXING DEVICE, AND IMAGE FORMING APPARATUS

(75) Inventor: Shifa Deng, Shanghai (CN)

(73) Assignee: Ricoh Company, Ltd., Tokyo (JP)

( * ) Notice: Subject to any disclaimer, the term of this patent is extended or adjusted under 35 U.S.C. 154(b) by 270 days.

(21) Appl. No.: 12/926,632

(22) Filed: Dec. 1, 2010

(65) Prior Publication Data

US 2011/0164889 A1 Jul. 7, 2011

(30) Foreign Application Priority Data

Jan. 5, 2010 (CN) ..... 2010 1 0003109

(51) Int. Cl.
*G03G 15/20* (2006.01)

(52) U.S. Cl.
USPC ..... 399/33

(58) Field of Classification Search
USPC ..... 399/33, 67–70
See application file for complete search history.

(56) References Cited

U.S. PATENT DOCUMENTS

| | | | | |
|---|---|---|---|---|
| 4,897,696 | A * | 1/1990 | Matsumoto | 399/33 |
| 6,959,158 | B2 * | 10/2005 | Ohta | 399/69 |
| 7,039,336 | B2 * | 5/2006 | Ohta | 399/69 |
| 7,106,987 | B2 * | 9/2006 | Ohta | 399/69 |
| 7,372,008 | B2 * | 5/2008 | Ohta et al. | 219/619 |
| 7,609,984 | B2 * | 10/2009 | Aoki et al. | 399/33 |
| 2004/0037580 | A1 * | 2/2004 | Ohta | 399/69 |
| 2006/0002730 | A1 * | 1/2006 | Ohta | 399/69 |
| 2006/0056866 | A1 * | 3/2006 | Oka et al. | 399/33 |
| 2006/0131301 | A1 * | 6/2006 | Ohta et al. | 219/619 |
| 2006/0140657 | A1 * | 6/2006 | Ohta | 399/69 |
| 2007/0075065 | A1 | 4/2007 | Miyoshi | |
| 2007/0075066 | A1 * | 4/2007 | Miyoshi | 219/216 |

FOREIGN PATENT DOCUMENTS

| | | | |
|---|---|---|---|
| CN | 1936727 | | 3/2007 |
| JP | 01146285 | A * | 6/1989 |
| JP | 2007-329041 | | 12/2007 |

* cited by examiner

*Primary Examiner* — G. M. Hyder
(74) *Attorney, Agent, or Firm* — Harness, Dickey & Poerce, P.L.C.

(57) ABSTRACT

Disclosed are a heating unit and its malfunction determining method, an image fixing device including the heating unit, and an image forming apparatus including the image fixing device. The method comprises a temperature detection step of detecting temperature of a heating body in the heating unit; a first malfunction determination step of obtaining a temperature rise time of the heating body, and then determining whether there is malfunction in the heating unit; and a second malfunction determination step of calculating a temperature increase rate of the heating body, and then determining whether there is malfunction in the heating unit.

15 Claims, 4 Drawing Sheets

HEATING UNIT AND ITS MALFUNCTION DETERMINING METHOD, IMAGE FIXING DEVICE, AND IMAGE FORMING APPARATUS

BACKGROUND OF THE INVENTION

1. Field of the Invention

The present invention relates to a malfunction determining method of a heating unit, a heating unit using the malfunction determining method, an image fixing device including the heating unit, and an image forming apparatus including the image fixing device.

2. Description of the Related Art

In a conventional image forming apparatus such as a copier, a printer, etc., after one or more toner images are formed on a recording paper, it is necessary to carrying out an image fixing process of dealing with the toner images on the recording paper by an image fixing device so as to fix the toner images on the recording paper. In general, the conventional image forming apparatus carries out the image fixing process to deal with hot-melt toner by a combination of heating and pressurization. As a result, it is very important to the quality of fixing the toner images whether the temperature of a heating unit in the image fixing device is normal. Once the temperature of the heating unit is not normal, it may affect not only the quality of fixing the toner images but also the safety of the whole image forming apparatus. Therefore it is very important that whether there is malfunction in the heating unit can be determined timely and accurately.

In Japanese Patent Laid-Open Publication No. 2007-329041, an image fixing device having a malfunction determining function is disclosed. In this image fixing device, during a time period from the time when a heating unit begins to be heated to the time when the temperature of the heating unit reaches a predetermined image fixing temperature, it is determined according to the temperature increase rate of the heating unit whether there is malfunction in the heating unit. In particular, in a case where the temperature increase rate of the heating unit is in a range of 10° C./s to 13° C./s, it is determined that there is no malfunction in the heating unit (i.e. the heating unit is in a normal state); in other cases, it is determined that there is malfunction in the heating unit (i.e. the heating unit is not in a normal state).

In Chinese Patent Laid-Open Publication No. 1936727A, an image fixing device having a malfunction determining function is also disclosed. In this image fixing device, during a time period from the time when a heating unit begins to be heated to the time when the temperature of the heating unit reaches a predetermined stand-by temperature, it is determined according to the temperature rise time of the heating unit whether there is malfunction in the heating unit.

It is apparent that, in the above-mentioned two conventional techniques, the same technical approach is employed to carry out the malfunction determination no matter what temperature range the heating unit is currently in.

However, in a situation where the heating unit begins to be heated from a low temperature stage, when the temperature of the heating unit is still at the low temperature stage, i.e., the temperature of the heating unit has not reached a mid-to-high temperature stage yet, the temperature increase rate of the heating unit is relatively slow. Especially at the beginning of a time period where the heating unit is heated, the temperature increase rate of the heating unit is very slow; that is, as shown in FIG. 1, the temperature increase rate of the heating unit can reach a relatively stable state only after a predetermined time period where the heating unit is heated continually. As a result, in a circumstance where the temperature of the heating unit is at the low temperature stage, if the malfunction determination is carried out by using the temperature increase rate as described in the Japanese Patent Laid-Open Publication No. 2007-329041, it is determined that there is malfunction in the heating unit if the temperature increase rate is not in the range of 10° C./s to 13° C./s. It is apparent that this may cause a severe problem of false reporting, and cannot satisfy an accuracy demand of malfunction determination. Due to the property that the temperature increase rate of the heating unit is not stable at the low temperature stage, it is very difficult to choose a proper parameter by which the malfunction determination can be carried out timely and accurately.

Furthermore, as shown in FIG. 1, with the continuance of heating applied to the heating unit, the temperature increase rate of the heating unit speeds up gradually. After the temperature of the heating unit reaches the mid-to-high temperature stage, if there is malfunction in the heating unit and the malfunction cannot be detected timely, the recording paper may be burned with the increase in temperature, and eventually other parts of the heating unit or the image forming apparatus may be damaged. As a result, in a case where the temperature of the heating unit is at the mid-to-high temperature stage, timeliness of malfunction determination of the heating unit is strongly required. However, in a situation where the temperature of the heating unit is at the mid-to-high temperature stage, if the malfunction determination is carried out by using the temperature rise time as described in the Chinese Patent Laid-Open Publication. No. 1936727A, the timeliness demand of the malfunction determination cannot be satisfied.

It is apparent that, in the above-mentioned two conventional techniques, since the property of temperature increase and the demand of the malfunction determination of the heating unit are different as the temperature ranges in which the temperature of the heating unit may be are different, if the malfunction determination is carried out by employing the temperature increase rate or the temperature rise time at the middle-temperature stage and the high-temperature stage, the accuracy and the timeliness of the malfunction determination may be affected.

SUMMARY OF THE INVENTION

In order to overcome the disadvantages of the prior art, embodiments of the present invention propose a malfunction determining method of determining malfunction in a heating unit by using different technical approaches based on different temperature ranges of the heating unit, a heating unit using the malfunction determining method, an image fixing device including the heating unit, and an image forming apparatus including the image fixing device.

A malfunction determining method of determining whether there is malfunction in a heating unit is provided in the embodiments of the present invention. The malfunction determining method comprises a temperature detection step of detecting temperature of a heating body in the heating unit; a first malfunction determination step of, in a case where the temperature of the heating body detected when the heating body begins to be heated is lower than a first predetermined temperature, obtaining temperature rise time from the time when the heating body begins to be heated to the time when the temperature of the heating body reaches the first predetermined temperature, and then determining whether there is malfunction in the heating unit based on the obtained temperature rise time of the heating body; and a second malfunction determination step of, in a case where the temperature of the heating body detected during a time period in which the heating body is heated continually is higher than or equal to the first predetermined temperature and lower than or equal to a second predetermined temperature, calculating temperature increase rate of the heating body, and then determining whether there is malfunction in the heating unit based on the calculated temperature increase rate of the heating body.

A heating unit is provided in the embodiments of the present invention. The heating unit comprises a heat source; a heating body heated by the heat source; a temperature detection unit for detecting temperature of the heating body; and a malfunction determination unit for determining whether there is malfunction in the heating unit. In a case where the temperature of the heating body detected by the temperature detection unit when the heating body begins to be heated is lower than a first predetermined temperature, the malfunction determination unit obtains temperature rise time from the time when the heating body begins to be heated to the time when the temperature of the heating body reaches the first predetermined temperature, and then determines whether there is malfunction in the heating unit based on the obtained temperature rise time of the heating body. In a case where the temperature of the heating body detected by the temperature detection unit during a time period in which the heating body is heated continually is higher than or equal to the first predetermined temperature and lower than or equal to a second predetermined temperature, the malfunction determination unit calculates temperature increase rate of the heating body, and then determines whether there is malfunction in the heating unit based on the calculated temperature increase rate of the heating body.

Furthermore an image fixing device is provided in the embodiments of the present invention. The image fixing device comprises the heating unit.

Furthermore an image forming apparatus is provided in the embodiments of the present invention. The image forming apparatus comprises the image fixing device.

Compared to the above-mentioned technical proposals in which the malfunction determination is carried out by employing the same technical approach even in different temperature ranges, since the technical proposal of the embodiments of the present invention employs different technical approaches to determine whether there is malfunction in the heating unit based on different properties of temperature increase and different demands of malfunction determination of the heating unit in different temperature ranges, the technical proposal of the embodiments of the present invention can improve the accuracy and the timeliness of malfunction determination at the same time.

DETAILED DESCRIPTION OF THE PREFERRED EMBODIMENTS

Hereinafter, embodiments of the present invention will be concretely described with reference to the drawings.

Figure 1:
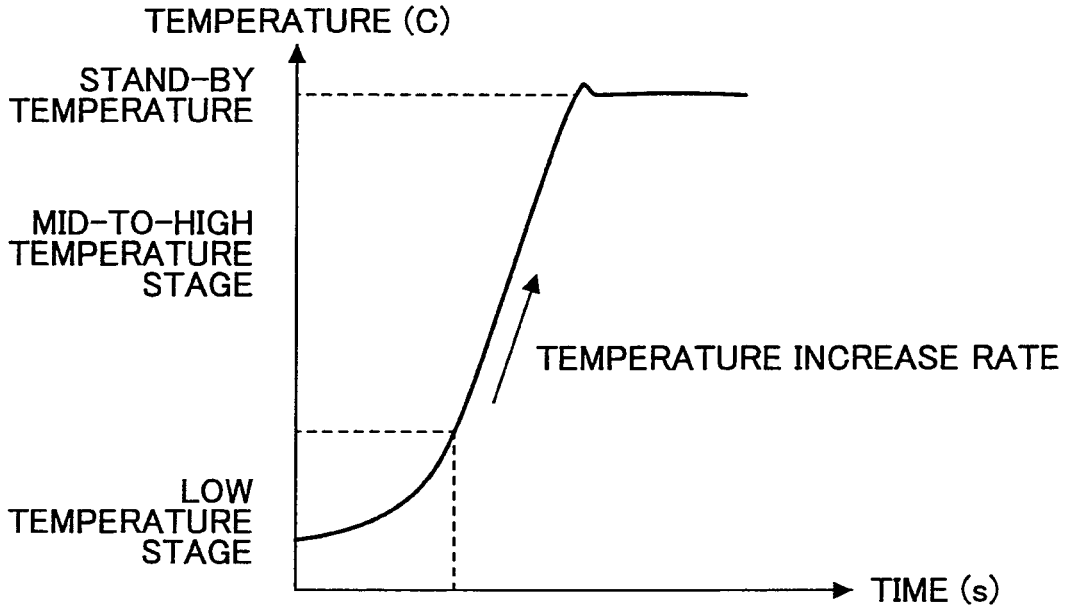
FIG. 1 illustrates a curve of the property of temperature increase of a heating unit.
Figure 2:
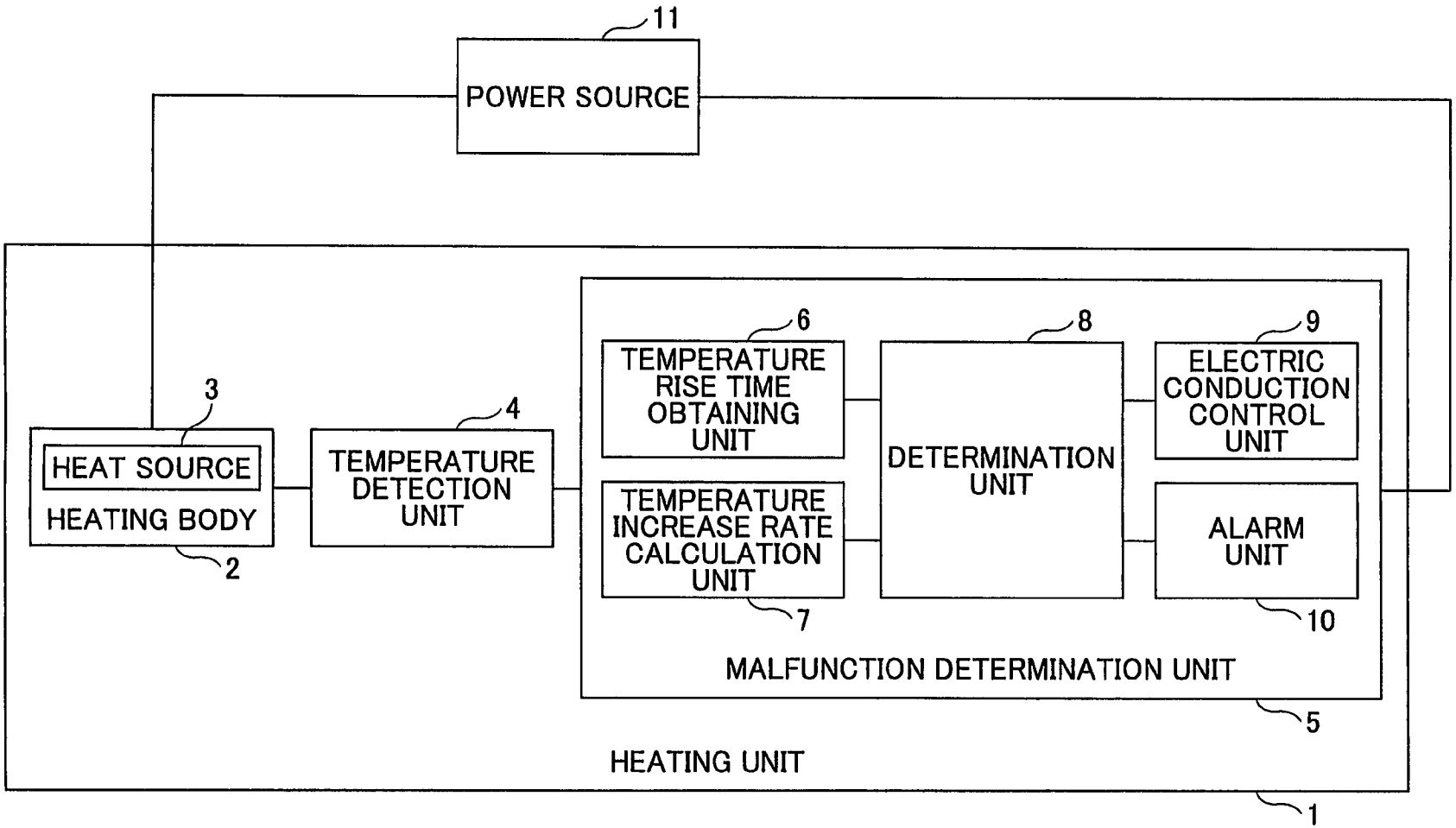
FIG. 2 illustrates the structure of heating unit.

FIG. 2 illustrates the structure of a heating unit 1. As shown in FIG. 2, the heating unit 1 comprises a heating body 2, a temperature detection unit 4, and a malfunction determination unit 5.

In this embodiment, there is a heat source 3 in the heating body 2; the heat source 3 is an electric heat source such as an infrared heat source, an electrically-heated wire, a filament, etc. The heat source 3 generates heat when electric current is applied by a power source 11, and then heats the heating body 2 by thermal irradiation. The heat source 3 may also be disposed on the outside of the heating body 2. Also a fluid heat source may be utilized in the heating unit 1; for example, a gas-typed heat source or a liquid-typed heat source may serve as the heat source 3.

The temperature detection unit 4 is used for detecting the temperature of the heating body 2, and then sending the detected temperature of the heating body 2 to the malfunction determination unit 5.

Figure 3:
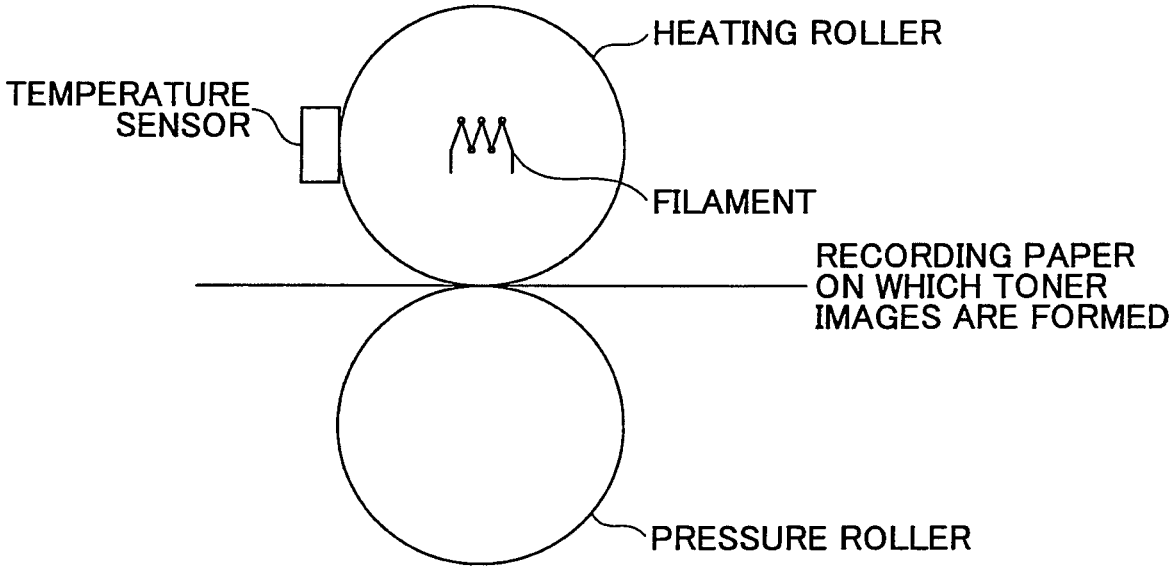
FIG. 3 illustrates an example of a heating body and an example of a temperature detection unit.

FIG. 3 illustrates an example of the heating body 2 and an example of the temperature detection unit 4. In an actual image forming apparatus (such as a copier) in which an image fixing process is carried out by a combination of heating and pressurization, for example, in a structure shown in FIG. 3, a heating roller corresponds to the heating body 2, a filament corresponds to the heat source 3, and a temperature sensor corresponds to temperature detection unit 4. When a recording paper on which one or more toner images are formed passes between the heating roller and a pressure roller, the heating roller and the pressure roller carry out a heating process and a pressurizing process, respectively; in this way, the image fixing process can be realized.

The malfunction determination unit 5 includes a temperature rise time obtaining unit 6, a temperature increase rate calculation unit 7, a determination unit 8, an electric conduction control unit 9, and an alarm unit 10. The temperature rise time obtaining unit 6 is used for obtaining the temperature rise time of the heating body 2 based on the temperature of the heating body 2 detected by the temperature detection unit 4. The temperature increase rate calculation unit 7 is used for calculating the temperature increase rate of the heating body 2 based on the temperature of the heating body 2 detected by the temperature detection unit 4. In a case where the temperature of the heating body 2 detected by the temperature detection unit 4 when the heating body 2 begins to be heated is lower than a first predetermined temperature, the determination unit 8 determines whether there is malfunction in the heating unit 1 base on the temperature rise time of the heating body 2 obtained by the temperature rise time obtaining unit 6. In a case where the temperature of the heating body 2 detected by the temperature detection unit 4 is higher than or equal to the first predetermined temperature and lower than or equal to a second predetermined temperature, the determination unit 8 determines whether there is malfunction in the heating unit 1 base on the temperature increase rate of the heating body 2 calculated by the temperature increase rate calculation unit 7. When the determination unit 8 determines that there is malfunction in the heating unit 1, the electric conduction control unit 9 controls the power source 11 to cut off the power supplied to the heat source 3 based on the determination result of the determination unit 8 so as to cause the heat source 3 to stop heating the heating body 2; at the same time, the alarm unit 10 gives a warning.

Figure 4:
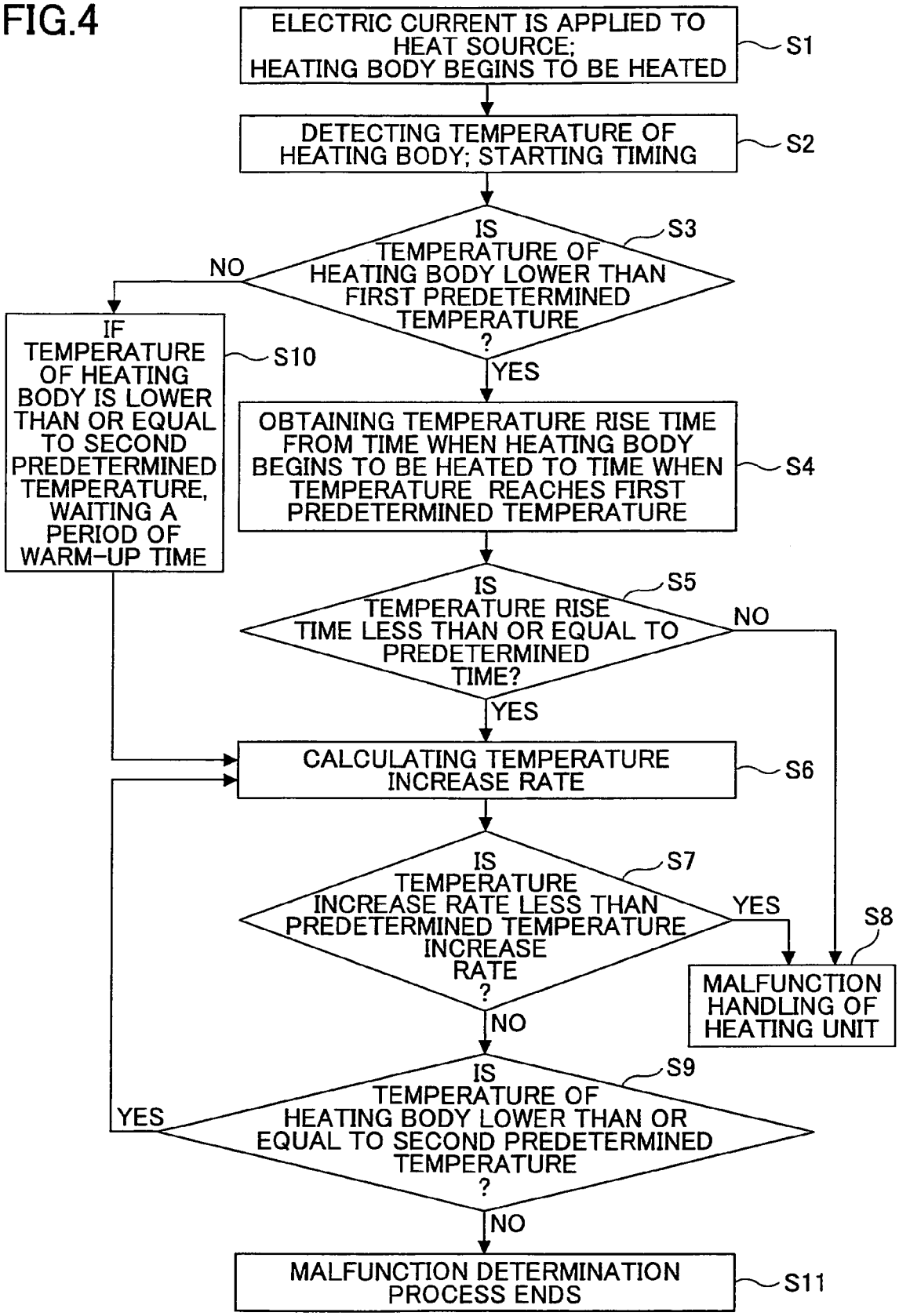
FIG. 4 is a flowchart of a malfunction determination process of a heating unit.

In what follows, a malfunction determination process of the heating unit 1 is illustrated according to FIG. 4.

In STEP S1, the power source 11 supplies power to the heat source 3 in order to let the heat source 3 generate heat; at the same time, the heating body 2 is heated.

In STEP S2, from the time when the heating body 2 begins to be heated, the temperature detection unit 4 begins to detect the temperature of the heating body 2; at the same time, a timer (not shown in FIG. 2) in the temperature rise time obtaining unit 6 is reset and begins to work.

In STEP S3, it is determined whether the temperature of the heating body 2 detected by the temperature detection unit 4 when the heating body 2 begins to be heated is lower than the first predetermined temperature. In a case where the temperature of the heating body 2 detected by the temperature detection unit 4 when the heating body 2 begins to be heated is lower than the first predetermined temperature (i.e. "YES" in STEP S3), the process goes to STEP S4; otherwise the process goes to STEP S10.

In STEP S4, the temperature rise time obtaining unit 6 obtains the temperature rise time from the time when the heating body 2 begins to be heated to the time when the temperature of the heating body 2 reaches the first predetermined temperature based on the temperature of the heating body 2 detected by the temperature detection unit 4. A concrete method of obtaining the temperature rise time is as follows: the timer in the temperature rise time obtaining unit 6 stops timing when the temperature of the heating body 2 reaches the first predetermined temperature.

Desirably, in STEP S4, it is possible to use the following method to obtain the temperature rise time, i.e., if the temperature of the heating body 2 reaches the first predetermined temperature in a predetermined time period, the timer in the temperature rise time obtaining unit 6 stops timing when the temperature of the heating body 2 reaches the first predetermined temperature; if the temperature of the heating unit 2 is still lower than the first predetermined temperature after the predetermine time period, the timer in the temperature rise time obtaining unit 6 stops timing just after the predetermined time period. In this embodiment, the predetermined time period desirably is 10 seconds.

In STEP S5, the determination unit 8 determines whether there is malfunction in the heating unit 1 based on the temperature rise time of the heating body 2 obtained by the temperature rise time obtaining unit 6, i.e., based on the timing result of the timer in the temperature rise time obtaining unit 6. A concrete determination method is as follows: when the timing result of the timer in the temperature rise time obtaining unit 6 is less than or equal to a predetermined time, i.e., when the temperature rise time of the heating body 2 is less than or equal to the predetermined time (i.e. "YES" in STEP S5), the determination unit 8 determines that the heating unit 1 is currently in a normal state, and then the process goes to STEP 8; when the timing result of the time in the temperature rise time obtaining unit 6 is greater than the predetermined time, i.e., when the temperature rise time of the heating body 2 is greater than the predetermined time (i.e. "NO" in STEP S5), the determination unit 8 determines that there is malfunction in the heating unit 1, then the determination unit 8 sends the determination result to the electric conduction control unit 9 and the alarm unit 10, and then the process goes to STEP S8.

In a case where the temperature of the heating body 2 detected by the temperature detection unit 4 after continuous heating is higher than or equal to the first predetermined temperature and lower than or equal to the second predetermined temperature, the temperature increase rate calculation unit 7 calculates the temperature increase rate of the heating body 2 in STEP S6. In this embodiment, 100 ms serves as a desirable sampling rate for calculating the temperature of the heating body 2.

In STEP S7, when the temperature increase rate of the heating body 7 calculated by the temperature increase rate calculation unit 7 is greater than or equal to a predetermined temperature increase rate, the determination unit 8 determines that the heating unit 1 is currently in a normal state, and then the process goes to STEP S9. When the temperature increase rate of the heating body 2 calculated by the temperature increase rate calculation unit 7 is less than the predetermined temperature increase rate, the determination unit 8 determines that there is malfunction in the heating unit 1, then the determination unit 8 sends the determination result to the electric conduction control unit 9 and the alarm unit 10, and then the process goes to STEP S8. In this embodiment, the predetermined temperature increase rate desirably is 10° C./s. However, since there are different properties of temperature increase in different structures, those trained in the art may set a proper value of the predetermined temperature increase rate based on the property of temperature increase of the heating body 2.

In STEP 9, if the temperature of the heating body 2 detected by the temperature detection unit 4 is still lower than or equal to the second predetermined temperature, the process goes back to STEP S6 to repeatedly carry out STEPS S6~S9 until the temperature of the heating body 2 detected by the temperature detection unit 4 reaches the second predetermined temperature. When the temperature of the heating body 2 detected by the temperature detection unit 4 reaches the second predetermined temperature, the process goes to STEP S11, i.e., the malfunction determination process ends.

In STEP S3, in case where the temperature of the heating body 2 detected by the temperature detection unit 4 when the heating body 2 begins to be heated is higher than or equal to the first predetermined temperature (i.e. "NO" in STEP S3), the process goes to STEP S10. At the same time, if the temperature of the heating body 2 is lower than or equal to the second predetermined temperature, the process goes to STEP S6 after waiting a period of warm-up time, and then carries out the follow-on steps from STEP S6. In this embodiment, the period of warm-up time is a period of time from the time when the heating body 2 begins to be heated to the time when the temperature of the heating body 2 can rise stably. The period of warm-up time in this embodiment is 2 seconds; however, those practiced in the art may set a different period of warm-up time.

In STEP S8, a malfunction handling of the heating unit 1 is carried out. In particular, in STEP S8, the electric conduction control unit 9 controls the power source 11 to cause it to cut off the power supplied to the heat source 3 so as to stop heating the heating body 2. At the same time, the alarm unit 10 gives a warning based on the determination result of the determination unit 8.

In this embodiment, the first predetermined temperature is one to separate low temperature and mid-to-high temperature, and the second predetermined temperature is a stand-by temperature. The first predetermined temperature desirably is 45° C., and the second predetermined temperature desirably is 150° C. in this embodiment. However, those skilled in the art may set different values of the first and second predetermined temperature based on the different structures of the heating bodies 2; for example, the first predetermined temperature may be 40° C. to 55° C., and second predetermined temperature may be 100° C. to 170° C. for a different structure of the heating body 2.

The above-mentioned heating unit 1 may be used in an image fixing device. And the image fixing device including the heating unit 1 may be used in an image forming apparatus such as a copier, a printer, etc.

While the present invention is described with reference to the specific embodiments chosen for purpose of illustration, it should be apparent that the present invention is not limited to these embodiments, but numerous modifications could be made thereto by those skilled in the art without departing from the basic concept and scope of the present invention.

The present application is based on Chinese Priority Patent Application No. 201010003109.2 filed on Jan. 5, 2010, the entire contents of which are hereby incorporated by reference.

What is claimed is:

1. A method for determining a malfunction in a heating unit, comprising:

a temperature detection step of detecting a temperature of a heating body in the heating unit;

a first malfunction determination step of, in a case where the temperature of the heating body detected when the heating body begins to be heated is lower than a first predetermined temperature, obtaining a temperature rise time from the time when the heating body begins to be heated to the time when the temperature of the heating body reaches the first predetermined temperature, and then determining whether there is the malfunction in the heating unit based on the obtained temperature rise time of the heating body via a temperature rise time obtaining unit; and a second malfunction determination step of, in a case where the temperature of the heating body detected during a time period in which the heating body is heated continually is higher than or equal to the first predetermined temperature and lower than or equal to a second predetermined temperature, calculating temperature increase rate of the heating body, and then determining whether there is the malfunction in the heating unit based on the calculated temperature increase rate of the heating body via a temperature increase rate calculation unit, wherein the first predetermined temperature is configured to separate low temperature and mid-to-high temperature.

2. The method according to claim 1, wherein:

in a case where the temperature of the heating body detected when the heating body begins to be heated is higher than or equal to the first determined temperature and lower than or equal to the second predetermined temperature, the temperature increase rate of the heating body is calculated after a period of warm-up time, and then it is determined, according to the calculated temperature increase rate of the heating body, whether there is the malfunction in the heating unit.

3. The method according to claim 1, wherein:

when the temperature rise time of the heating body from the time when the heating body begins to be heated to the time when the temperature of the heating body reaches the first predetermined temperature is less than or equal to a predetermined temperature rise time, it is determined that the heating unit is normal; when the temperature of the heating body is still lower than the first predetermined temperature after a period of the predetermined temperature rise time, the obtaining of the temperature rise time of the heating body is stopped, and then it is determined that there is the malfunction in the heating unit.

4. The method according to claim 1, wherein:

when the calculated temperature increase rate of the heating body is greater than or equal to a predetermined temperature increase rate, it is determined that the heating unit is normal; when the calculated temperature increase rate of the heating body is less than the predetermined temperature increase rate, it is determined that there is the malfunction in the heating unit.

5. The method of claim 1, wherein the second predetermined temperature is a stand-by temperature.

6. The method of claim 1, wherein the first predetermined temperature is greater than or equal to 40° C. and less than or equal to 55° C., and the second predetermined temperature is greater than or equal to 100° C and less than or equal to 170° C.

7. A heating unit, comprising:

a heat source;

a heating body heated by the heat source;

a temperature detection unit for detecting a temperature of the heating body; and a malfunction determination unit for determining whether there is a malfunction in the heating unit, wherein, in a case where the temperature of the heating body detected by the temperature detection unit when the heating body begins to be heated is lower than a first predetermined temperature, the malfunction determination unit including a temperature rise time obtaining unit obtains a temperature rise time from the time when the heating body begins to be heated to the time when the temperature of the heating body reaches the first predetermined temperature, and then determines whether there is the malfunction in the heating unit based on the obtained temperature rise time of the heating body, and in a case where the temperature of the heating body detected by the temperature detection unit during a time period in which the heating body is heated continually is higher than or equal to the first predetermined temperature and lower than or equal to a second predetermined temperature, the malfunction determination unit including a temperature increase rate calculation unit calculates a temperature increase rate of the heating body, and then determines whether there is the malfunction in the heating unit based on the calculated temperature increase rate of the heating body, wherein the first predetermined temperature is configured to separate low temperature and mid-to-high temperature.

8. The heating unit according to claim 7, wherein:

in a case where the temperature of the heating body detected by the temperature detection unit when the heating body begins to be heated is higher than or equal to the first determined temperature and lower than or equal to the second predetermined temperature, the malfunction detection unit calculates the temperature increase rate of the heating body after a period of warm-up time, and then determines, according to the calculated temperature increase rate of the heating body, whether there is the malfunction in the heating unit.

9. The heating unit according to claim 7, wherein:

when the temperature rise time of the heating body from the time when the heating body begins to be heated to the time when the temperature of the heating body reaches the first predetermined temperature is less than or equal to a predetermined temperature rise time, it is determined that the heating unit is normal; when the temperature of the heating body is still lower than the first predetermined temperature after a period of the predetermined temperature rise time, the obtaining of the temperature rise time of the heating body is stopped, and then it is determined that there is the malfunction in the heating unit.

10. The heating unit according to claim 7, wherein:

when the calculated temperature increase rate of the heating body is greater than or equal to a predetermined temperature increase rate, it is determined that the heating unit is normal; when the calculated temperature increase rate of the heating body is less than the predetermined temperature increase rate, it is determined that there is the malfunction in the heating unit.

11. The heating unit according to claim 7, wherein:

the heat source is an electric heat source, and generates heat by applying an electric current to the heat source.

12. An image fixing device comprising:

the heating unit according to claim 7.

13. An image forming apparatus comprising:

the image fixing device according to claim 12.

14. The heating unit of claim 7, wherein the second predetermined temperature is a stand-by temperature.

15. The heating unit of claim 7, wherein the first predetermined temperature is greater than or equal to 40° C. and less than or equal to 55° C., and the second predetermined temperature is greater than or equal to 100° C. and less than or equal to 170° C.

* * * * *